United States Patent [19]

Adams

[11] 4,372,267

[45] Feb. 8, 1983

[54] FUEL PUMPING APPARATUS

[75] Inventor: Graham L. Adams, Potters Bar, England

[73] Assignee: Lucas Industries Limited, Birmingham, England

[21] Appl. No.: 235,567

[22] Filed: Feb. 18, 1981

[30] Foreign Application Priority Data

Feb. 20, 1980 [GB] United Kingdom ..... 8005640

[51] Int. Cl.[3] ..... F02D 31/00

[52] U.S. Cl. ..... 123/366; 123/367; 123/372

[58] Field of Search ..... 123/366, 367, 365, 372

[56] References Cited

U.S. PATENT DOCUMENTS

| | | | |
|---|---|---|---|
| 3,572,304 | 3/1971 | Becker et al. | 123/366 |
| 3,871,344 | 3/1975 | Pigeroulet et al. | 123/367 |
| 4,204,510 | 5/1980 | Ritter et al. | 123/366 |
| 4,223,653 | 9/1980 | Jaenke et al. | 123/366 |
| 4,254,753 | 3/1981 | Ritter et al. | 123/366 |

FOREIGN PATENT DOCUMENTS

| | | | |
|---|---|---|---|
| 2725641 | 12/1978 | Fed. Rep. of Germany | 123/366 |

*Primary Examiner*—Ira S. Lazarus
*Assistant Examiner*—Magdalen Moy

[57] ABSTRACT

A fuel pumping apparatus includes a control rod movable in an axial direction to vary the quantity of fuel delivered by the apparatus. A stop member is engageable with a part on the control rod to determine the normal maximum amount of fuel which can be supplied. The stop member can be moved laterally by a first spring to allow an excess of fuel to be supplied. A temperature responsive second spring opposes the action of the first spring, the second spring at normal operating temperature exerting a greater force than the first spring but when cold shrinking to allow movement of the stop member by the first spring.

4 Claims, 9 Drawing Figures

FUEL PUMPING APPARATUS

This invention relates to a fuel apparatus for supplying fuel to an internal combustion engine and of the kind comprising an injection pump, an axially movable control rod the axial position of which determines the amount of fuel supplied by the injection pump at each delivery stroke, speed responsive means for moving the control rod with increasing speed, in the direction to reduce the amount of fuel supplied by the injection pump, a governor spring acting to oppose movement of the control rod by the speed responsive means and a stop acting to limit the extent of movement of the control rod in the direction to increase the amount of fuel delivered by the apparatus.

It is known with such apparatus to provide means for temporarily rendering the aforesaid stop ineffective so that the apparatus can supply an amount of fuel in excess of the normal maximum for the purpose of facilitating the starting of the associated engine. This is effected by forming the stop in two parts, one part in use being fixed in the housing of the apparatus and the other part engaging with the one part and with an abutment on the control rod to determine the normal maximum delivery of fuel by the apparatus. The aforesaid other part is however movable laterally with respect to the axis of movement to the control rod to a position in which it permits the extra movement of the control rod, such movement taking place under the action of the aforesaid governor spring. The movement of the aforesaid other part is effected manually by depression of a suitable knob on the exterior of the housing of the apparatus. Once the engine has started the other part is returned to its original position by a spring member.

It is required that the selection of the excess fuel for starting purposes should be automatic and be responsive to the temperature of the apparatus and the object of the present invention is to provide an apparatus of the kind specified in which this is achieved.

According to the invention in an apparatus of the kind specified said stop comprises a member engageable with a part of said control rod, said member being movable to an inoperative position to allow further movement of the control rod in a direction to increase the amount of fuel delivered in use by the apparatus, first resilient means acting to bias said member to the inoperative position, and temperature responsive means acting when the temperature to which it is exposed attains a predetermined value, to move said member to an operative position.

An example of an apparatus in accordance with the invention will now be described with reference to the accompanying drawings in which.

Figure 1:
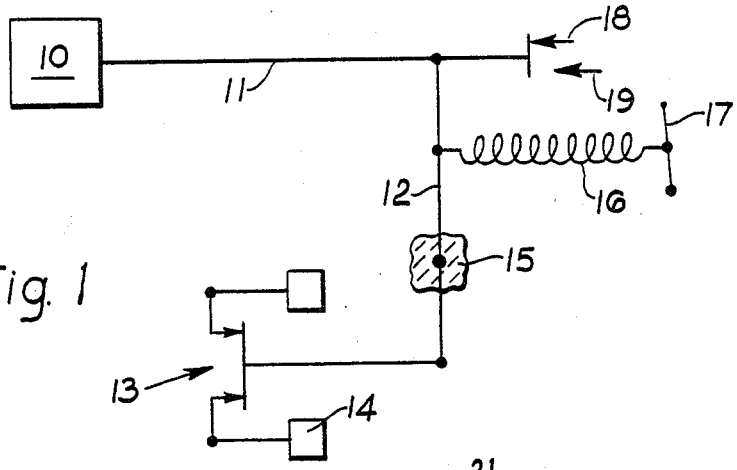
FIG. 1 is a diagrammatic illustration of the apparatus.

With reference to FIG. 1 of the drawings the apparatus comprises an injection pump which is indicated at 10 and an axially movable control rod indicated at 11, the axial position of the control rod determining the amount of fuel delivered in use, by the injection pump and hence the apparatus, at each delivery stroke thereof. Also provided is a pivotal lever 12 one end of which is pivotally connected to the control rod and the other end of which is connected to a speed responsive mechanism generally indicated at 13. The particular mechanism is a centrifugal mechanism and includes weights 14 which as the speed at which the apparatus is driven increases, move outwardly to effect anti-clockwise movement of the lever 12 about its pivot 15. The control rod 11 will be moved towards the left as seen in FIG. 1 in the direction to reduce the amount of fuel supplied at each delivery stroke. Movement of the lever and control rod by the speed responsive mechanism is opposed by the action of a governor spring 16 which in this case is shown as being a coiled tension spring connected to a driver operable lever 17. By movement of the lever 17, the force exerted by the spring 16 can be varied. As the force exerted by the spring is increased the control rod 11 will move to the right in the direction to increase the amount of fuel delivered by the injection pump at each delivery stroke.

It is necessary to limit the maximum amount of fuel which can be delivered to the engine and for this purpose there is shown diagrammatically in FIG. 1, a stop 18. The construction of the stop 18 will be described in detail with reference to the remaining drawings. There is also provided a stop control 19 and this is a manually operable device which can be actuated to engage with a part of the control rod 11 to urge the control rod to a position in which no fuel will be delivered by the pump to the associated engine.

Figure 2:
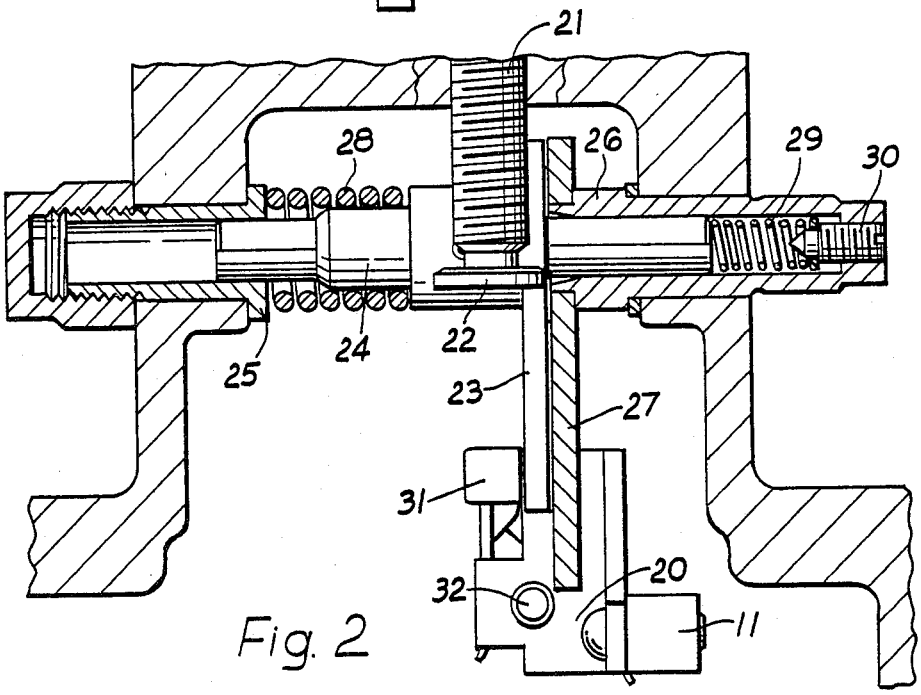
FIG. 2 is a sectional side elevation of a portion of a practical form of the apparatus with the various parts in the normal running position.
Figure 3:
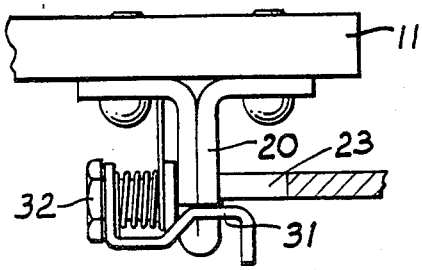
FIG. 3 is a plan view of part of the apparatus seen in FIG. 2.

Turning now to FIGS. 2 and 3 the control rod is indicated at 11 and it has mounted thereon a laterally extending projection 20. The stop diagrammatically shown at 18 in FIG. 1, is formed in two parts, one of which indicated at 21, is in the form of a threaded member engaged within an aperture in the housing of the apparatus. The threaded member is provided with a head 22 which is engaged by a surface on the other of the two members, said other member being referenced 23. The other member is in the form of a plate, the plane of which extends substantially parallel to the axis of movement of the control rod and the plate is mounted upon the rod 24 which is located within bearing bushes 25,26 located in the housing. The rod 24 is axially movable in the bushes and the member 23 constituted by the plate is movable with the rod, that is to say laterally with respect to the axis of movement of the control rod 11. The member 23 has a surface for engagement as shown in FIG. 3, with the projection 20 and the governor spring 16 urges the control rod so that the projection 20 engages the plate and the plate engages the head 22. As shown in FIGS. 2 and 3, the engine is operating normally and the control rod has assumed its position appropriate to maximum fuel. Thus even though the force exerted by the spring 16 may be increased no further movement of the control rod 11 will take place. The position of the head 22 can be adjusted for the purpose of setting up the apparatus.

The bush 26 is angularly movable within the housing and extends beyond the housing and in practice will have an arm mounted thereon connected to a driver operable stop control. When this is actuated a member 27 again in the form of a plate, is moved into engagement with the projection 20 to move the control rod 11 to a position in which no fuel is delivered by the apparatus. When the driver operated control is released the plate is moved away from the projection. It should be noted that the member 27 is not illustrated in FIG. 3.

The member 23 is shown in its operative position and it is retained in this position when the engine is operating normally, by means of a coiled spring 28 which acts between a shoulder on the rod 24 and the end of the bush 25. The spring 28 is constructed from a wire formed from a special alloy manufactured by the Delta Metal Company Limited, P.O. Box 22, Hadley Road, Ipswich, England. The feature of this spring is that when hot it expands and behaves as a normal spring but when it is cold it contracts to the close coiled state. A further spring 29 is provided and this acts upon the end of the rod 24 which is located within the sleeve 26, moreover, an adjustable abutment 30 is provided for the opposite end of the spring, the abutment 30 being adjustably mounted within the sleeve 26. The spring 29 is a normal coiled compression spring.

The projection 20 mounts a spring loaded latch 31, the latch 31 includes an arm portion which is pivotally connected to the projection at the axis 32 and the latch is biassed by a helically wound spring, in the direction towards the control rod 11.

Figure 4:
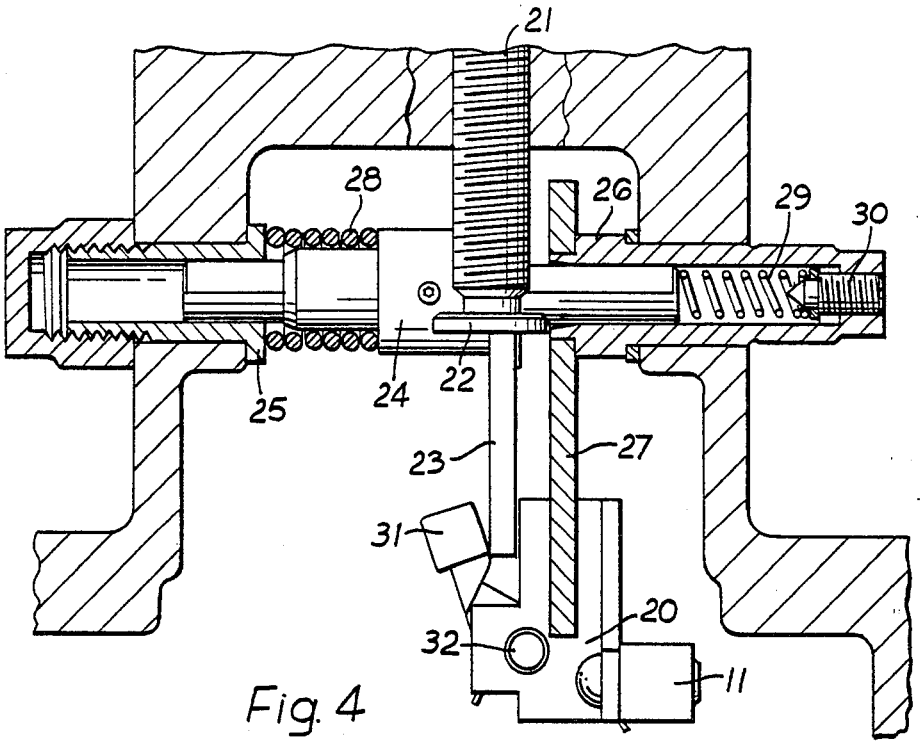
FIGS. 4 and 6 and FIGS. 5, 7 are views similar to FIGS. 2 and 3 respectively with the parts in alternative positions.
Figure 5:
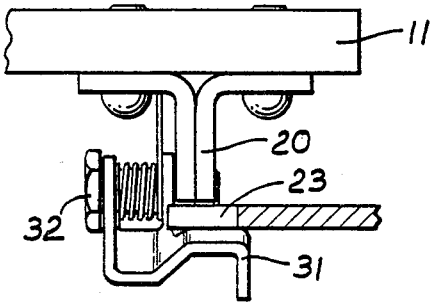
Figure 6:
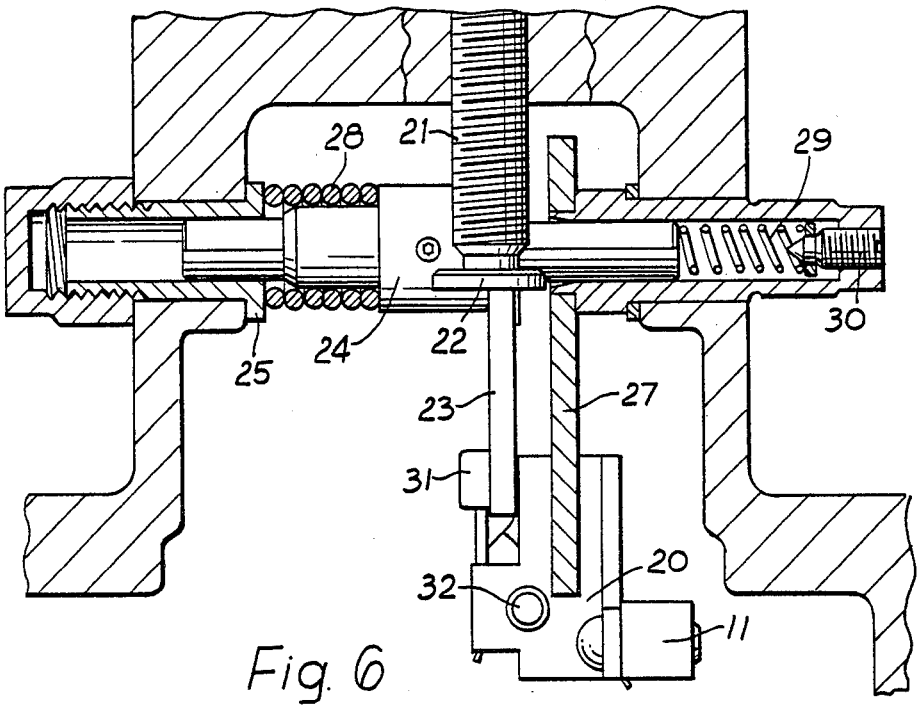
Figure 7:
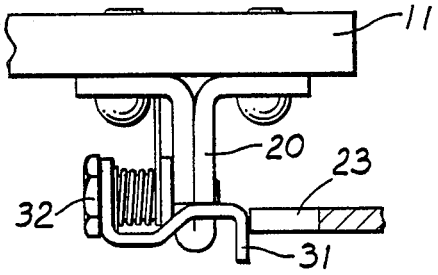

Turning now to FIGS. 4 and 5, these figures show the position adopted by the various parts when the engine is cold and when excess fuel is required to facilitate the starting of the engine. It will be noted that the spring 28 has contracted and has allowed the rod 24 to move axially under the action of the spring 29. This movement has caused the member 23 to move to an inoperative position by displacing the latch 31 and as will be seen in FIG. 5, the member 23 has been moved clear of the projection 20 and the latter, together with the control rod has moved an additional amount under the action of the governor spring 16. Thus when the associated engine is cranked for starting purposes, an additional quantity of fuel will be delivered by the apparatus at each delivery stroke. When the associated engine starts and the speed responsive device moves the control member to reduce the amount of fuel supplied to the engine, the projection 20 will move towards the left as seen in FIG. 5 permitting the latch to return to its operative position. This situation is shown in FIGS. 6 and 7, it will be noted however that in this condition the plate 23 instead of engaging with the projection 20 engages with a part of the latch 31 and the practical effect of this is that the maximum fuel which can be supplied to the engine immediately after it has been started and the supply of excess fuel has ceased, it less than the normal maximum. The member 23 is still in its inoperative position although in fact in this position it is acting to limit the amount of fuel supplied to the engine. It will remain in this position until the spring 28 has reached a predetermined temperature and when this occurs the spring expands and moves the rod 24 against the action of the spring 29. The parts thus return to the position shown in FIGS. 2 and 3 and the member 23 can engage with the projection 20.

The mechanism described above automatically supplies excess fuel to the engine for starting purposes when the engine is cold. It does however suffer from two disadvantages, these being that if the operator should accidentically operate the stop control whilst the engine is stationary, then the projection 20 will be moved from the position shown in FIG. 4 and immediately the latch 31 is clear of the member 23 it will assume the position shown in FIGS. 6 and 7. In this position and as described, less than the normal maximum amount of fuel can be supplied and therefore it is unlikely that the engine could be started. It is also possible that it may be necessary to have excess of fuel for starting purposes even when the spring 28 is in its expanded state.

Figure 8:
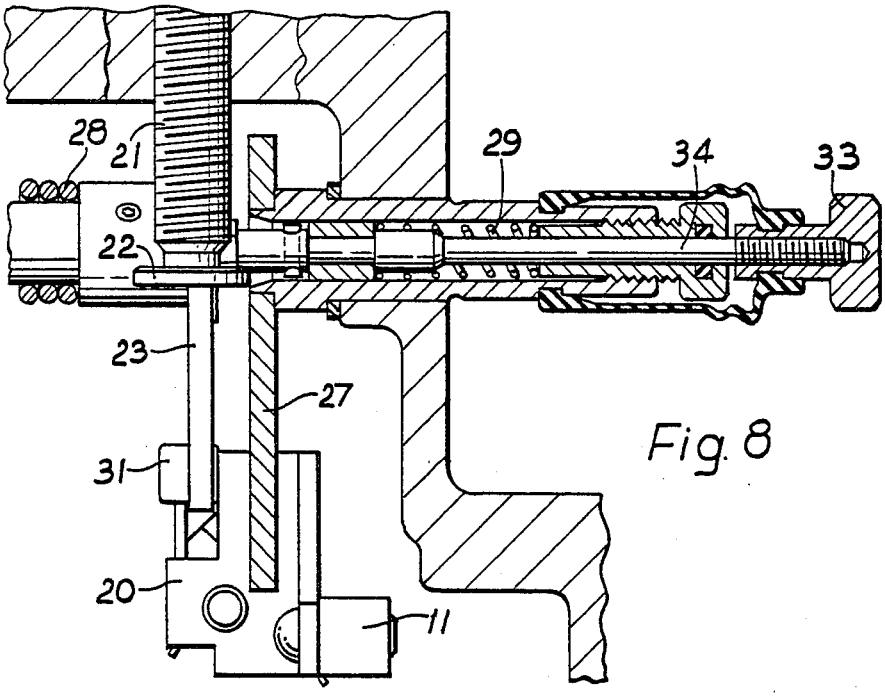
FIG. 8 is a view similar to FIG. 2 showing a modified form of the apparatus with the various parts in one position.
Figure 9:
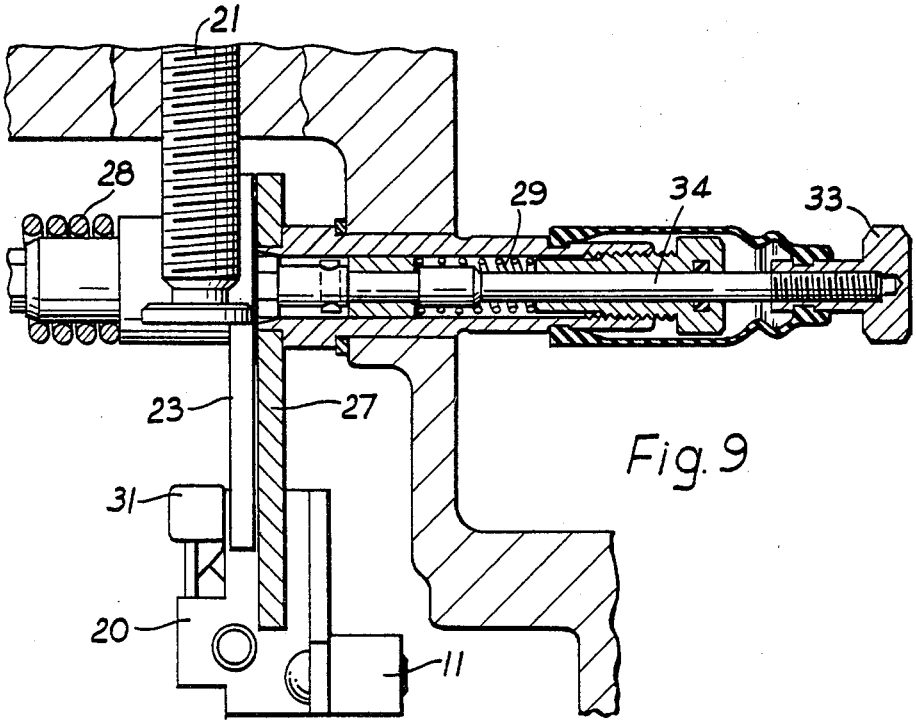
FIG. 9 shows a view similar to FIG. 8 with the parts in another position.

Referring to FIG. 8 this shows the spring 28 in its collapsed state and it shows the latch in the operative position, in other words the member 23 is engaged with the latch rather than the projection 20. In order to obtain excess fuel in this situation the member 23 is moved to the right as seen in FIG. 8 to permit the control rod and projection to move under the action of the governor spring and then the member is released to allow displacement of the latch as seen in FIGS. 4 and 5. The displacement of the member 23 is achieved by means of a manually operable control 33 accessible from the exterior of the apparatus. The control is connected to a rod 34 which is a modified and extended part of the rod 24 seen in the earlier drawings. The spring 29 is provided as in the previous examples but in this case the abutment for the spring is provided with a bore through which the rod 34 can extend. In FIG. 9 it will be seen that the spring 28 is in its expanded state with the member 23 engaging the projection 20. In order to select excess fuel the member 23 is moved to the left as seen in FIG. 9 to displace the latch 31 and to permit the projection to move under the action of the governor spring. Once again the control 33 is utilised for this purpose, but in this case it is depressed to compress the spring 28.

I claim:

1. A fuel pumping apparatus for supplying fuel to an internal combustion engine and of the kind comprising an injection pump, an axially movable control rod the axial position of which determines the amount of fuel supplied by the injection pump at each delivery stroke, speed responsive means for moving the control rod with increasing speed in the direction to reduce the amount of fuel supplied by the injection pump, a governor spring acting to oppose movement of the control rod by the speed responsive means, a plate movable laterally relative to the direction of movement of the control rod and engageable with a part of the control rod, an axially movable shaft mounting said plate, said plate having a stop surface for engagement with said part of the control rod and a further surface engageable with an adjustable abutment carried by a housing of the apparatus, said adjustable abutment acting to determine the position of the stop surface, said plate when in an operative position acting to limit the extent of movement of the control rod in the direction to increase in use the amount of fuel delivered by the apparatus, said plate being movable to an inoperative position to allow further movement of the control rod in a direction to increase in use the amount of fuel delivered by the apparatus, first resilient means acting to bias said plate to the inoperative position, and second resilient means acting when the temperature to which it is exposed attains a predetermined value to move said plate to its operative position, said second resilient means being formed as a coiled compression spring from an alloy whereby when the temperature is below said predetermined value the spring assumes a close coiled state and when the temperature is above said predetermined value the spring expands and behaves as a normal spring.

2. An apparatus according to claim 1 in which said coiled compression spring is located about said shaft on one side of the plate said first resilient means being in the form of a coiled compression spring which acts upon said shaft in opposition to the force exerted by said first mentioned coiled compressioned spring.

3. An apparatus according to claim 2 including a latch member pivotally mounted on said part of the control rod, spring means biassing said latch member to an operative position, said latch member being movable to an inoperative position by lateral movement of the plate to its inoperative position, under the action of said first resilient means, said latch member returning to its operative position when the control rod is moved by the action of the speed responsive means upon starting of the associated engine, said latch member when in its operative position and when said plate is in its inoperative position acting to limit the amount of fuel which can be supplied by the apparatus to a valve which is less than that obtained when the plate is in its operative position.

4. An apparatus according to claim 3 including manually operable means connected to said shaft and operable to effect axial movement of said shaft.

* * * * *